United States Patent [19]

Lombardo

[11] Patent Number: 4,809,906

[45] Date of Patent: Mar. 7, 1989

[54] RETURN MAILER IN PLACE OF FLIP WINDOW

[75] Inventor: Leo Lombardo, Manchester, N.H.

[73] Assignee: Moore Business Forms, Inc., Grand Island, N.Y.

[21] Appl. No.: 125,211

[22] Filed: Nov. 25, 1987

[51] Int. Cl.[4] ..... B65D 27/06

[52] U.S. Cl. ..... 229/73; 229/69; 229/71

[58] Field of Search ..... 229/69, 71, 73, 92.3

[56] References Cited

U.S. PATENT DOCUMENTS

| | | | |
|---|---|---|---|
| 1,307,421 | 6/1919 | Schramm | 229/92.3 |
| 3,273,785 | 9/1966 | Beckman et al. | 229/69 |
| 3,380,648 | 4/1968 | DeLyra | 229/71 |
| 3,693,869 | 9/1972 | Eaves, Jr. | 229/73 |
| 3,837,565 | 9/1974 | Johnsen | 229/68 R |
| 4,598,860 | 7/1986 | Pennock | 229/69 |
| 4,706,877 | 11/1987 | Jenkins | 229/73 |
| 4,709,850 | 12/1987 | Wagner | 229/73 |
| 4,715,530 | 12/1987 | Leese et al. | 229/73 |

*Primary Examiner*—Stephen Marcus
*Assistant Examiner*—Nova Stucker
*Attorney, Agent, or Firm*—Nixon & Vanderhye

[57] ABSTRACT

A business form assembly is provided in which the outer or top sheet is formed with a substantially rectangular window, which must be closed at the completion of the manufacturing stage. To this end, a patch or cover sheet with dimensions slightly larger than the window, is temporarily attached, by pressure sensitive adhesive, to the sheet next adjacent the top sheet but in overlying relationship with the window. The underside of the top sheet is provided with a heat activated adhesive pattern about the periphery of the window and facing the patch or cover. When the form is substantially complete, heat is applied to activate the various lines of adhesive utilized in the form, and including the pattern about the periphery of the window. In this manner, the patch or cover becomes permanently attached to the underside of the top sheet, and is easily removed from the adjacent sheet since the heat activated adhesive is stronger than the pressure sensitive adhesive.

11 Claims, 2 Drawing Sheets

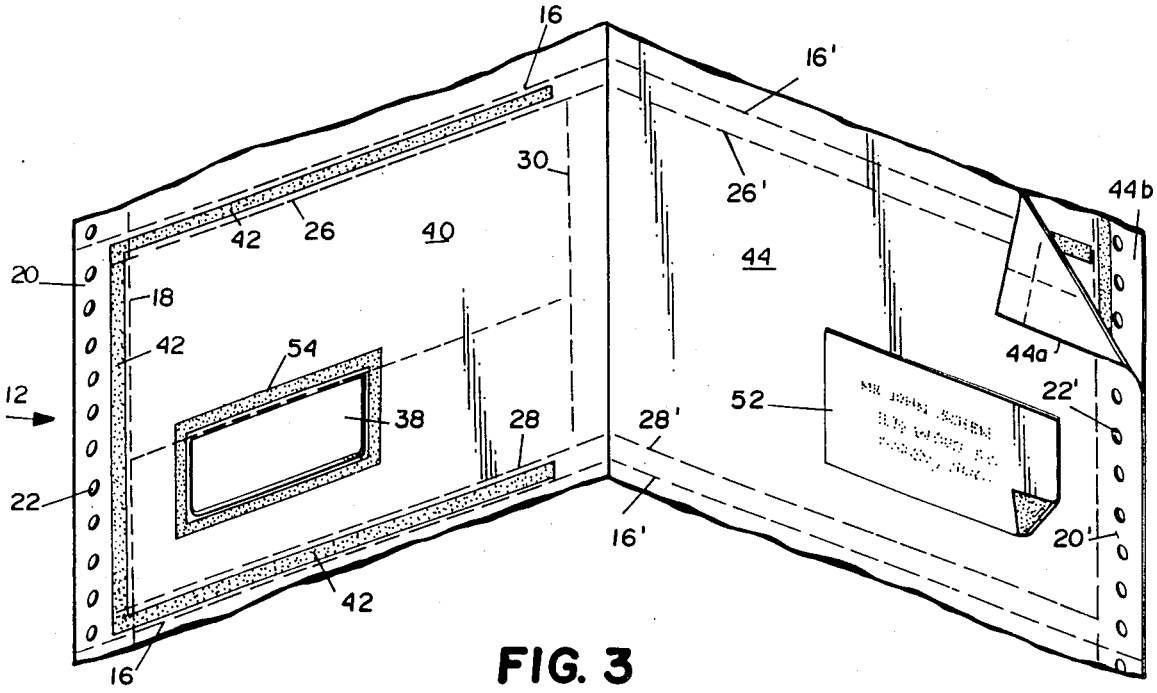
FIG. 3
FIG. 4
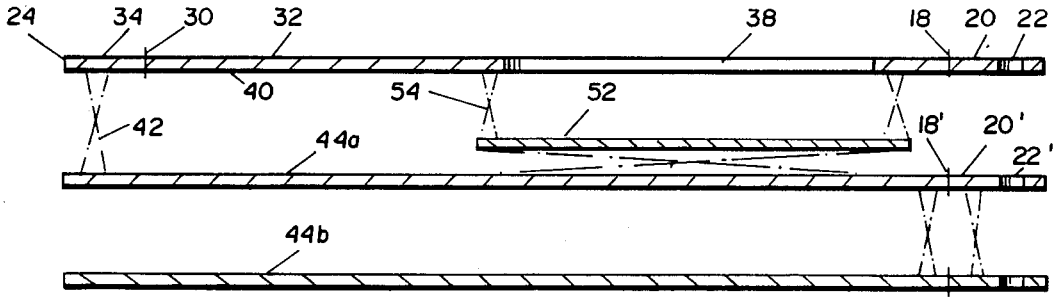

RETURN MAILER IN PLACE OF FLIP WINDOW

BACKGROUND AND SUMMARY OF THE INVENTION

This invention relates to business forms assemblies and, more specifically, to return-mailer type forms which include return envelopes and at least one window formed in a sheet adjacent the return envelope portion of the mailer.

It is known in the prior art to produce such forms with a so-called "flip-window" construction wherein the window is cut along three edges of a rectangle and folded back about a fourth edge. Accordingly, the resulting flap or panel may be folded back and forth between open and closed positions. This construction has proved advantageous because it permits the exterior side of the flap to be printed along with the interior side of the sheet in which the window is formed in a single printing step.

More specifically, it is usually the case that the interior surface of the top sheet is printed with billing or other account information or the like, while the exterior surface of the flap is printed with, for example, a name and address which faces outwardly when the flap or panel is in a window closing position. To effect simultaneous printing in a single step, the panel is simply folded back onto the interior of the sheet so that the exterior flap surface and interior sheet surface face the printer. This type of return-mailer construction can be found in U.S. Pat. No. 4,598,860.

As will be appreciated, the above described construction requires multiple window opening and closing steps during manufacture of the form, which steps are carried out manually or by machine. In either case, the process is relatively slow and causes many failures due to tearing of the window closing panel. As a result, even more stringent and time consuming inspection procedures are required to assure a quality product.

In the present invention, the above described prior art difficulties are eliminated by a simple redesign of the window closing structure of the form assembly. Specifically, in accordance with the present invention, the window is cut on all four sides and the cut-out panel is discarded. Thereafter, a paper patch or cover, with dimensions slightly larger than the window dimensions, is temporarily attached, by a releasable pressure sensitive adhesive for example, to the outer surface of the next adjacent sheet or web, so that when the sheets are superposed, the patch or cover completely overlies the window and a surrounding marginal area of the lower surface of the top sheet.

In addition, the marginal area surrounding the window has a heat activated adhesive applied thereto, in facing relationship to the patch or cover. When the respective sheets and patch are plied together during manufacture, one side of the patch or cover engages, but does not adhere to, the adhesive surrounding the window, while the other side of the patch is itself provided with pressure sensitive adhesive which temporarily, and releasably, secures the patch to the adjacent sheet.

During certain of the various manufacturing stages, typically involving a continuous web with individual form assemblies defined by transverse lines of perforations, it may be desirable that the top sheet be free of any window closing structure, and thus, in accordance with this invention, the patch will remain temporarily adhered to the next adjacent sheet permitting the top sheet to be manipulated as needed or desired with a completely open window structure. This arrangement also permits printing of the patch simultaneously with the adjacent sheet to which it is temporarily attached.

At a further manufacturing stage, where the form structure is substantially completed, heat is applied to activate the various adhesive lines included in the assembly. At this time, the adhesive applied about the periphery of the window is also activated to bond the patch to the underside of the top sheet, in overlying relationship with the window. At this stage, the patch is adhesively secured to both the top sheet as well as the next adjacent sheet. However, this seemingly undesirable situation is accommodated by the fact that the heat activated adhesive is considerably stronger than the pressure sensitive adhesive. Thus, upon separation of the top or cover sheet from the next adjacent sheet upon opening, the releasable, pressure sensitive adhesive will yield to the greater strength of the heat activated adhesive, and the patch or cover will therefore remain securely attached to the lower surface of the top sheet, covering and closing the window.

It will therefore be appreciated that this invention provides a higher quality product at increased manufacturing speed, resulting in greater forms acceptance rate and, therefore, reduced inspection requirements.

In a related aspect, this invention provides an improved method of manufacturing a business form assembly of the type which includes first and second superposed sheets, and wherein the first sheet is provided with a window, the improved method broadly comprising:

(a) providing a third sheet having a dimension greater than the window but lesser than the first and second sheets;

(b) temporarily and releasably adhering the third sheet to the second sheet during a first stage of manufacture; and (d) permanently securing the third sheet to the first sheet during a second stage of manufacture.

Further objects and advantages of the invention will become apparent form the detailed description which follows.

BRIEF DESCRIPTION OF THE DRAWINGS

FIG. 3 is a partial perspective of a continuous business forms assembly, with adjacent sheets separated along one marginal edge to illustrate the forms construction in accordance with this invention; and;

FIG. 4 is a cross-section of a forms construction in accordance with the present invention, taken along the line 4—4 of FIG. 2.

DETAILED DESCRIPTION OF THE DRAWINGS

Figure 1:
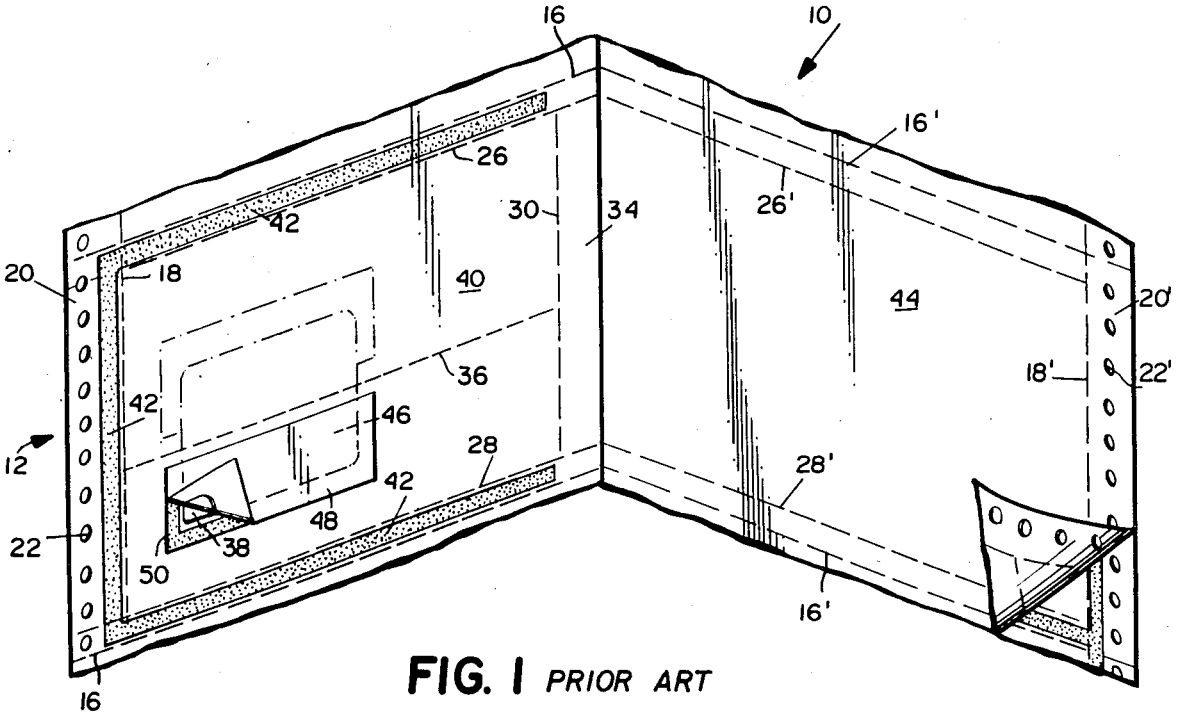
FIG. 1 PRIOR ART
FIG. 1 is a partial perspective view of a continuous business forms assembly with adjacent sheets separated along one marginal edge to illustrate a prior art forms construction.
Figure 2:
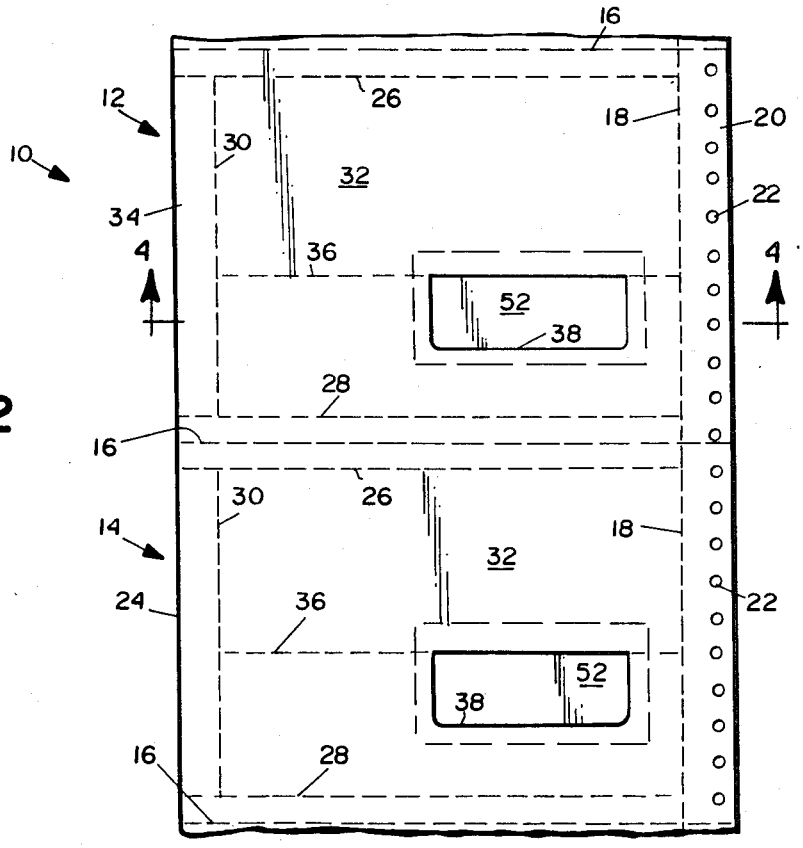
FIG. 2 is a partial top view of a continuous business forms assembly in accordance with this invention.

With reference now to FIGS. 1–3 a continuous business form assembly is shown at 10, with forms 12, 14, of the return-mailer-type extending longitudinally between transversely extending perforation lines 16. The forms 12, 14 are identical and, therefore, only one need be described in detail. Referring to form 12, for example, it will be appreciated that the form extends laterally between line 18 and a longitudinally extending marginal edge 24. The longitudinally extending perforation line 18 defines a removable marginal feed strip 20 provided with a line of feed holes 22. While no marginal feed strip is shown in association with the marginal edge 24, a second feed strip similar to strip 20 may be utilized if desired.

Additional transverse line of perforations 26, 28 and longitudinal lines of perforations 30 further define the form top sheet 32. A marginal strip 34, defined by line 30, may be removed by the recipient when it is desired to open the form. A transversely extending fold line 36 extends between perforation lines 18, 30 to divide the top sheet into, for example, a record portion to be retained by the user, and a separable remittance portion to be inserted in the return envelope. A window 38, generally rectangular in shape, is formed in the top sheet or cover 32.

The return-mailer top sheet 32 has an inside surface 40 provided with an adhesive strip 42 which extends along the periphery of perforation lines 18, 26 and 28.

The return mailer business form also includes a lower assembly on which the top sheet 32 is superposed. The lower assembly 44 may comprise two adhesively secured layers **44*a* and 44*b* forming a return envelope, which, in itself, is conventional and forms no part of this invention. In any event, with specific reference to FIGS. 1 and 3, the lower assembly 44 includes lines of perforations and feed holes which lie directly beneath a similar configuration on the top sheet 32. Reference numerals with prime designations denote lines, feed holes, etc. on the lower assembly 44 which lie directly underneath like elements on the top or cover sheet 32**.

To this point, the prior art return mailer assembly of FIG. 1 and the construction shown in FIGS. 2, 3 and 4 which represents the present invention, are substantially identical. The point of departure of the present invention involves the manner in which the window 38 in the top sheet 32 is ultimately covered.

In the prior art, the window 38 is formed by a U-shaped cut which defines a flap 46 which is foldable about the fold line 36 between a first position where flap 46 closes the window 38, and a second position, illustrated in phantom in FIG. 1, where the flap is folded back against the sheet 40, thus opening the window 38.

This arrangement is used so that during the manufacture of the form, the flap may be moved to its second position, permitting printed matter to be applied to the flap and to the inside surface 40 of the top sheet 32 in one printing step. Thereafter, the flap is closed, so that the printed matter thereon, such as an address, appears on the outside of the assembly.

To facilitate this back and forth movement of flap 46, an oversized backing sheet 48 is adhesively secured to the flap to prevent the flap from moving through the window as it is closed. In addition, the backing sheet is sized to engage a peripheral line of adhesive 50 applied to surface 40 substantially adjacent three edges of the U-shaped cut defining window 38. Thus, upon completion of the form, and with the window 38 closed by flap 46 and backing sheet 48, heat is applied, activating strip 50 to adhere the backing sheet 48 to the surface 40, thereby sealing the window closed.

As already described, this opening and closing process as it relates to window 38, flap 46 and backing sheet 48, slows down the form manufacturing process and causes numerous form failures.

In contrast, the present invention solves the prior art problems through the use of a patch or cover 52, the lower surface of which is provided with conventional, pressure sensitive adhesive by which the patch or cover may be temporarily applied to the upper or outer surface of adjacent sheet 44, at a location directly underneath the window 38. The patch in this case may be printed at the same time as sheet 44 which, in this exemplary embodiment, may constitute the front face of a return envelope assembly.

Heat activated, dry adhesive is applied to the lower or interior surface 40 of the sheet 32 as at 54, in surrounding relationship to the window 38. It will be appreciated that, in the normally superposed relationship, the periphery of patch 52 will overlie the adhesive strip 54. This arrangement is best seen in FIG. 3 as well as in the section illustrated in FIG. 4.

It will therefore be appreciated that the patch 52 remains adhesively secured to sheet 44 until the final heat sealing step, at which time the releasable adhesive will yield to the greater strength of the heat activated glue, and will thereafter remain secured to the surface 40 of sheet 32, overlying the window 38.

By this arrangement, the flip window feature of the prior art is eliminated, which in turn eliminates the time consuming 100% inspection process normally required. In addition, manufacturing speed is increased and overall quality is greatly improved.

It will be appreciated further that the above-described invention is applicable to many different types of business forms where one or more windows are formed in one sheet wherein the window or windows eventually are to be closed, and where at least one adjacent sheet is present which can temporarily support or mount the window patch or cover.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A return mailer assembly comprising:

(a) return envelope means including front and back sheets adhesively secured along at least three edges thereof;

(b) a top sheet overlying said envelope means, said top sheet divided into at least two separable sections, at least one of which is adapted to be returned in said return envelope means;

(c) window means formed in one of said two separable sections of said top sheet for displaying printed matter;

(d) cover means closing said window;

(e) first adhesive means on one side of said cover means for temporarily securing said cover means to the front sheet of said return envelope means; and (f) second adhesive means on said top sheet and extending about said window for permanently adhering said cover means to said top sheet in overlying relationship to said window means.

2. A return mailer assembly as defined in claim 1 wherein said second adhesive comprises dry adhesive activated by heat.

3. A return mailer assembly as defined in claim 2 wherein said first adhesive comprises pressure sensitive adhesive.

4. A return mailer assembly as defined in claim 1 wherein said cover means has an area greater than said window means.

5. A return mailer assembly as defined in claim 1 wherein said window means comprises a substantially rectangular aperture defined by four substantially straight edges, at least one of said edges lying along a fold line formed in said top sheet.

6. A continuous business form assembly comprising a continuous longitudinal web having a series of business forms defined by longitudinally spaced transverse lines of perforations, each of said forms comprising front and back superposed sheets, at least one of said front and back sheets provided with a window;

patch means for covering said window, said patch means being temporarily and releasably attached to the other of said front and back sheets by a first adhesive at a location directly opposite said window; a second adhesive located about the periphery of said window for permanently securing said patch means to said one sheet.

7. A continuous business form assembly as defined in claim 6, wherein said window is formed in said front sheet and wherein said back sheet forms one part of a two part return envelope assembly.

8. A continuous business form assembly as defined in claim 7 wherein said patch means is temporarily and releasably adhered to the back sheet by a pressure sensitive adhesive.

9. A continuous business form assembly as defined in claim 8 wherein said second adhesive is a heat activated adhesive.

10. A business form assembly comprising first and second sheets superposed one on the other, a first of said sheets having a window formed therein; a third sheet of lesser dimension than said first and second sheets overlying said window; first adhesive means for temporarily securing said third sheet to said second sheet during one stage of manufacture of the form, and second adhesive means for permanently securing said third sheet to said first sheet during another stage of manufacture.

11. A business form assembly as defined in claim 10 wherein said first adhesive means is a pressure sensitive adhesive means and said second adhesive is a heat activated adhesive.

* * * * *